US007497705B2

(12) United States Patent
Larson et al.

(10) Patent No.: US 7,497,705 B2
(45) Date of Patent: Mar. 3, 2009

(54) LOCKOUT DEVICE

(75) Inventors: Dwayne Larson, Milwaukee, WI (US); Michael Brojanac, Jackson, WI (US); Joe Elliott, Mequon, WI (US); Mark D. Johnson, Hubertus, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 11/854,016

(22) Filed: Sep. 12, 2007

(65) Prior Publication Data

US 2008/0081494 A1 Apr. 3, 2008

Related U.S. Application Data

(60) Provisional application No. 60/844,825, filed on Sep. 15, 2006.

(51) Int. Cl.
*H01R 13/44* (2006.01)

(52) U.S. Cl. ..... 439/133

(58) Field of Classification Search ..... 439/133, 439/134, 131, 135, 304, 346, 345; 200/43.02
See application file for complete search history.

(56) References Cited

U.S. PATENT DOCUMENTS

| | | | | |
|---|---|---|---|---|
| 2,664,734 | A | 1/1954 | McEneaney | |
| 2,733,416 | A | 1/1956 | Evatt | |
| 4,445,738 | A | 5/1984 | Wiencke | |
| 4,566,297 | A | 1/1986 | Hawley | |
| 4,932,886 | A | 6/1990 | Glaser | |
| 5,055,057 | A | 10/1991 | Boyer | |
| 5,507,656 | A | 4/1996 | Ales | |
| 5,551,884 | A | 9/1996 | Burkhart, Sr. | |
| 5,791,931 | A | 8/1998 | Burkhart, Sr. | |
| 6,193,539 | B1 | 2/2001 | Chang | |
| 6,461,176 | B1 | 10/2002 | Haas | |
| 6,508,654 | B1 | 1/2003 | Tatz | |
| 6,652,307 | B2 * | 11/2003 | Tatz | 439/346 |
| 6,773,277 | B2 | 8/2004 | Issa | |
| 6,945,805 | B1 * | 9/2005 | Bollinger | 439/348 |
| 6,979,220 | B1 * | 12/2005 | Ray et al. | 439/346 |
| 6,981,888 | B2 * | 1/2006 | O'Keefe et al. | 439/369 |

(Continued)

OTHER PUBLICATIONS

International Search Report and Written Opinion for International Application No. PCT/uS07/19814, mailed Apr. 21, 2008, 9 pages.

*Primary Examiner*—Alexander Gilman
(74) *Attorney, Agent, or Firm*—Calfee, Halter & Griswold LLP

(57) ABSTRACT

A lockout device is provided for an electrical plug. The device includes a body and a retaining member disposed within the body and axially movable between a prong retaining position and a prong releasing position. The retaining member includes a prong engaging portion and a prong retaining portion. The prong engaging portion is configured to engage at least one of the first and second prongs when the first prong is inserted in the first slot for movement of the retaining member from the prong releasing position to the prong retaining position. The prong retaining portion is configured to extend through the first transverse aperture when the first prong is inserted in the first slot, and is configured to withdraw from the first transverse aperture when the first prong is pulled from the first slot.

21 Claims, 7 Drawing Sheets

U.S. PATENT DOCUMENTS 6,986,674 B1 * 1/2006 Gorman ..... 439/140
7,104,818 B1 9/2006 Chang
7,175,463 B2 * 2/2007 Burton ..... 439/346
2002/0115331 A1 8/2002 Ho
2003/0207606 A1 11/2003 Ho

* cited by examiner

LOCKOUT DEVICE

CROSS REFERENCE TO RELATED APPLICATION

This application claims the benefit of U.S. Patent Application Ser. No. 60/844,825, entitled "ELECTRICAL PLUG LOCKING DEVICE" and filed Sep. 15, 2006, the entire contents of which are incorporated herein by reference, to the extent that they are not conflicting with the present application.

BACKGROUND

Many electrical devices are used in applications where it may be desirable to restrict access to their use, for example, where such use may be dangerous when involving unqualified individuals or where an electrical device is not functioning properly. While access to some electrical devices may be restricted by electronic safeguards, such as, for example, by electronic passcode, a simpler arrangement for preventing use of an electrical device involves use of a electrical plug lockout device, in which an enclosure or other obstruction is lockably secured to one or more prongs of an electrical plug by which the electrical device is powered, thereby preventing electrical connection of the plug to a power source, such as a wall socket.

SUMMARY

The present application describes lockout devices and methods which may be utilized for preventing unauthorized or accidental use of an electrical device by preventing the electrical device from being plugged into a power source.

Accordingly, in one embodiment, a lockout device is provided for an electrical plug having at least first and second prongs with corresponding first and second transverse apertures. The device includes a body and a retaining member. The retaining member is disposed within the body and axially movable with respect to a first slot, sized to receive the first prong, between a prong retaining position and a prong releasing position. The retaining member includes a prong engaging portion and a prong retaining portion. The prong engaging portion is configured to engage at least one of the first and second prongs when the first prong is inserted in the first slot for movement of the retaining member from the prong releasing position to the prong retaining position. The prong retaining portion is configured to extend through the first transverse aperture when the first prong is inserted in the first slot, and is configured to withdraw from the first transverse aperture when the first prong is pulled from the first slot.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description describes embodiments including inventive aspects of the present application and is not intended to limit the scope of the claims in any way. Indeed, the inventive aspects as described are broader than and unlimited by the preferred embodiments, and the terms used have their full ordinary meaning. For example, while the embodiments described herein relate to a lockout device for a standard two or three pronged 110 volt AC electrical plug, the inventive features may be utilized in locks or lockout devices for many different types of pronged connections or other types of mechanical connectors.

The present application contemplates a lockout device that is configured to impede or prevent access to a connector, such as, for example, a two-pronged 110 volt AC electrical plug, in order to prevent use of the device associated with the connector. While many different configurations may be provided to obstruct access to the connector, in one embodiment, a lockout device includes a body in which all or part of the connector may be received, and a retaining member disposed within the body for securing the connector therein. To secure the connector within the body, the retaining member may be movable from a releasing position to a retaining position.

Many different mechanisms may be utilized to move a retaining member from a releasing position to a retaining position, including, for example, plungers, slides, rotatable cams, and buttons, any of which may, but need not, be spring loaded. According to an inventive aspect of the present application, a lockout device may be configured such that insertion of all or part of the connector into the body moves a retaining member from a releasing position to a retaining position, in which the connector is retained by the retaining member. This arrangement may eliminate the need for additional manipulation of the locking device (e.g., a lever, button, or cam) to retain the connector. A locking mechanism or arrangement for securing the retaining member in the retaining position may be employed to prevent or impede subsequent withdrawal of the connector from the body. When the retaining member is no longer secured in the retaining position, the retaining member may, but need not, be free to move back to the releasing position, for example, by axially pulling the connector away from the body.

Figure 1:
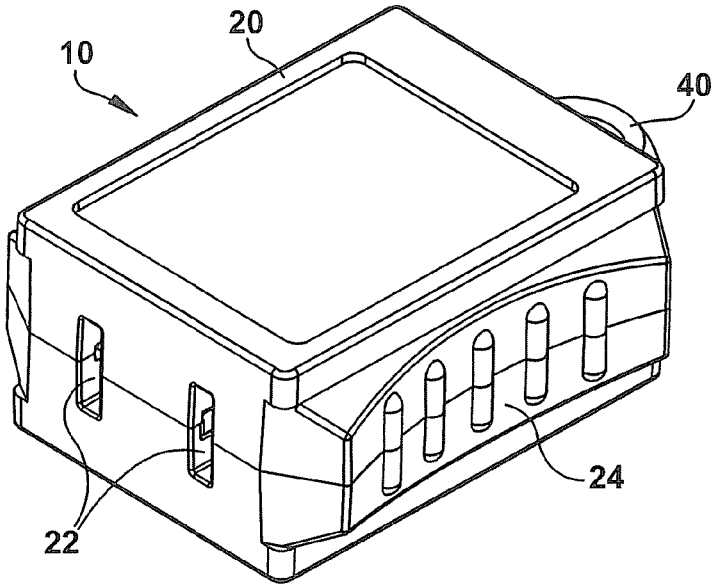
FIG. 1 is a perspective view of a lockout device.
Figure 2:
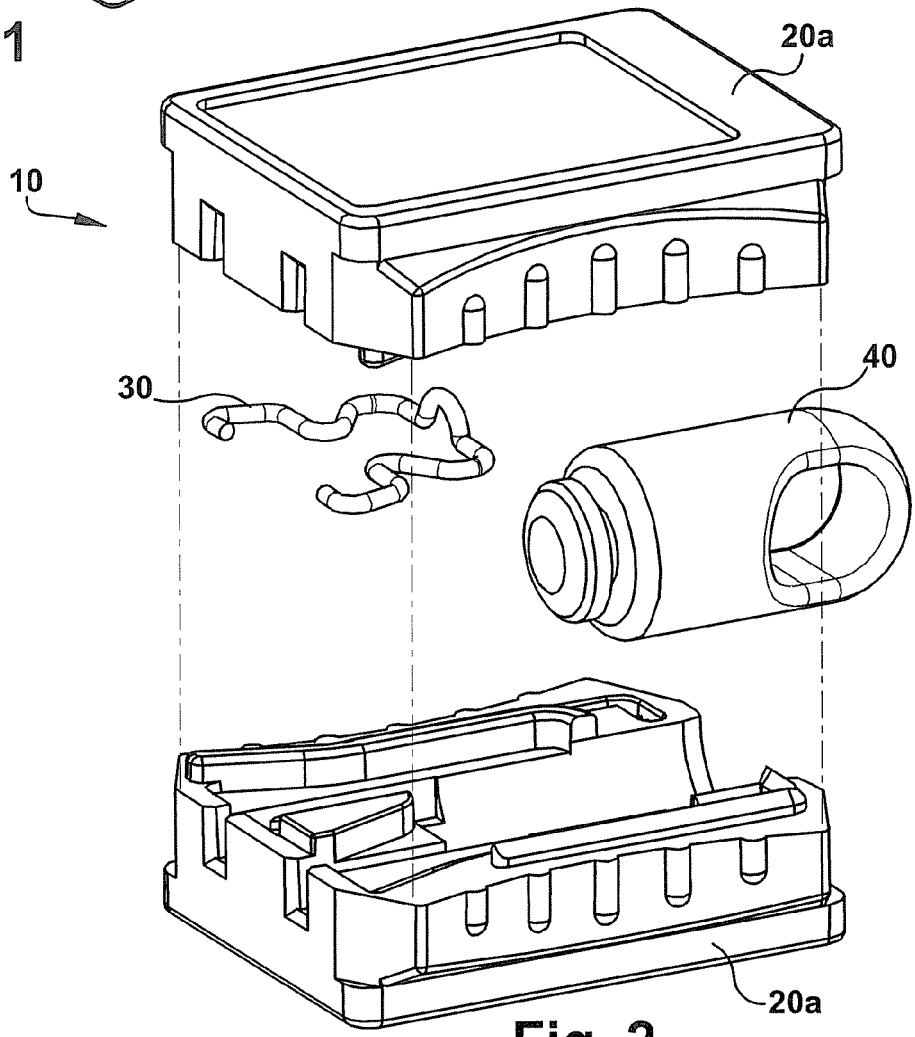
FIG. 2 is an exploded perspective view of the lockout device of FIG. 1.

FIGS. 1-6 illustrate an exemplary embodiment of a lockout device 10 for a 110 volt AC electrical plug. As shown in FIGS. 1 and 2, the device 10 includes a body 20 with slots 22 in a first end sized to receive prongs P1, P2 of a standard 110 volt AC electrical plug (see FIGS. 3A-3C). When the prongs P1, P2 of the plug P are secured in the body 20, the plug P is prevented from being coupled to a source of electrical power, such as a wall outlet. In another embodiment (not shown), a lockout device could include only one slot to lockably retain only one of a plug's prongs, which may also effectively prevent use of the plug and its associated electrical device.

Figure 3C:
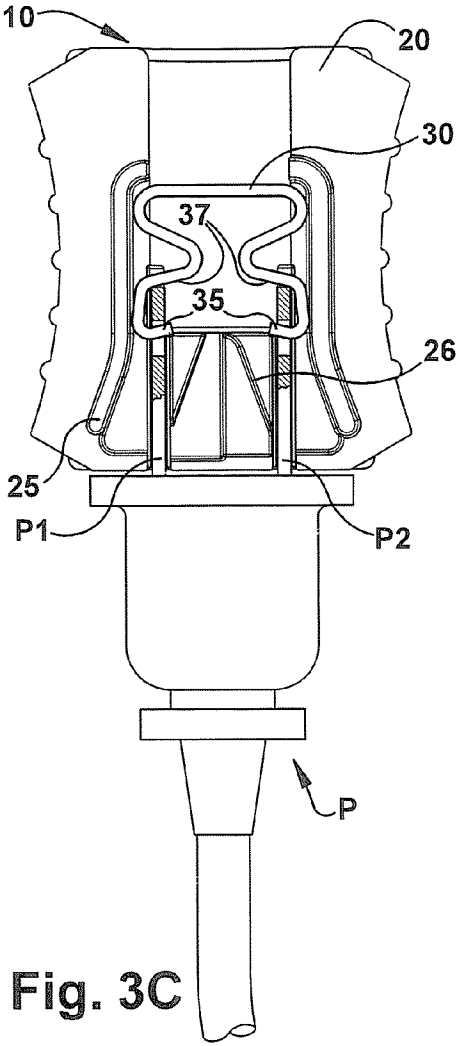
FIGS. 3A, 3B, and 3C illustrate cross-sectional views of the lockout device of FIG. 1, shown without the plunger, showing insertion of an electrical plug into the lockout device.
Figure 3B:
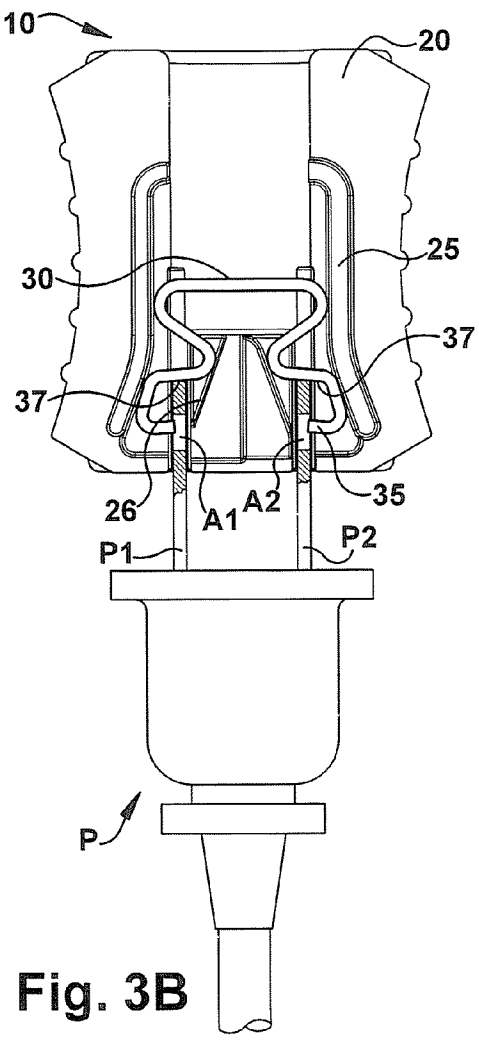
Figure 3A:
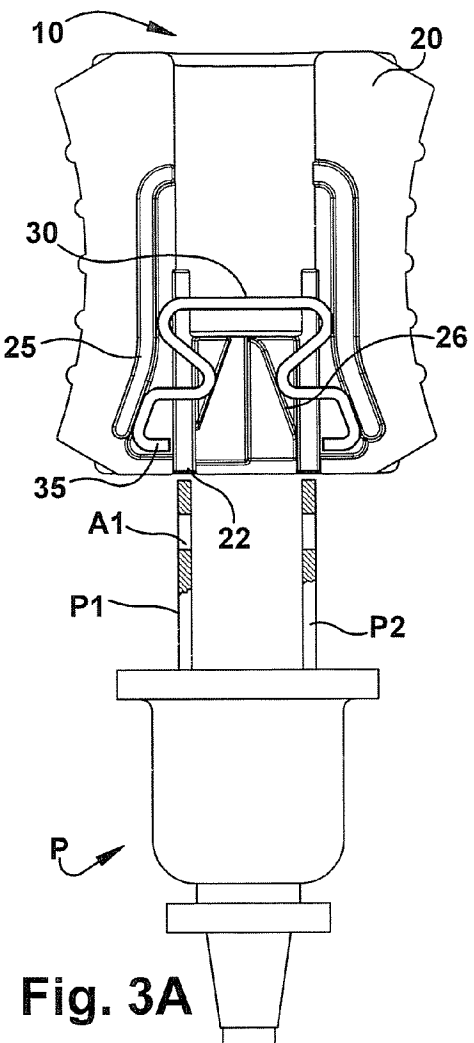
Figure 4A:
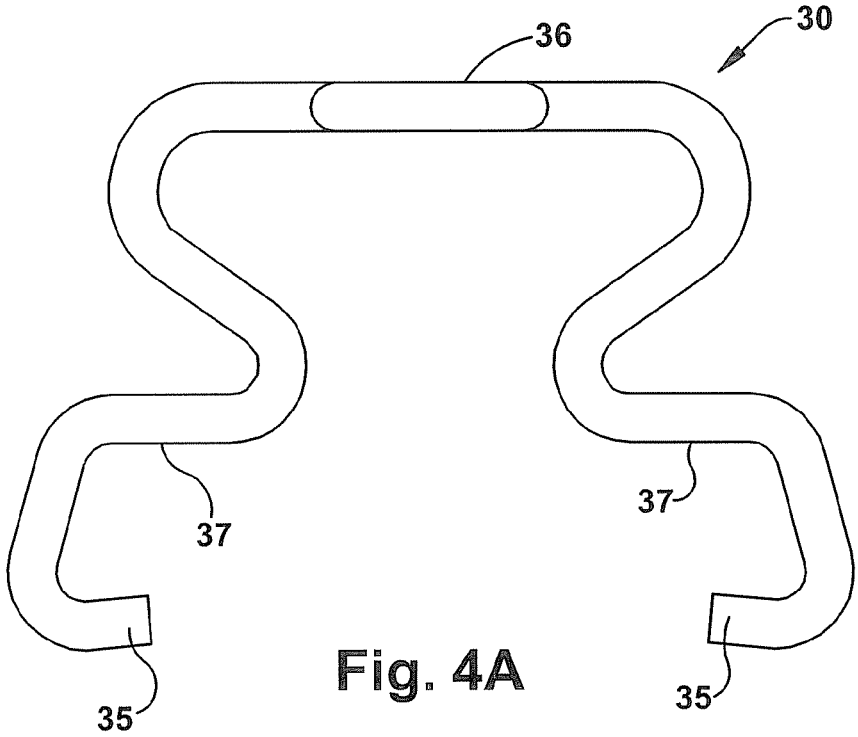
FIG. 4A illustrates a front view of the retaining member of the lockout device of FIG. 1.
Figure 4B:
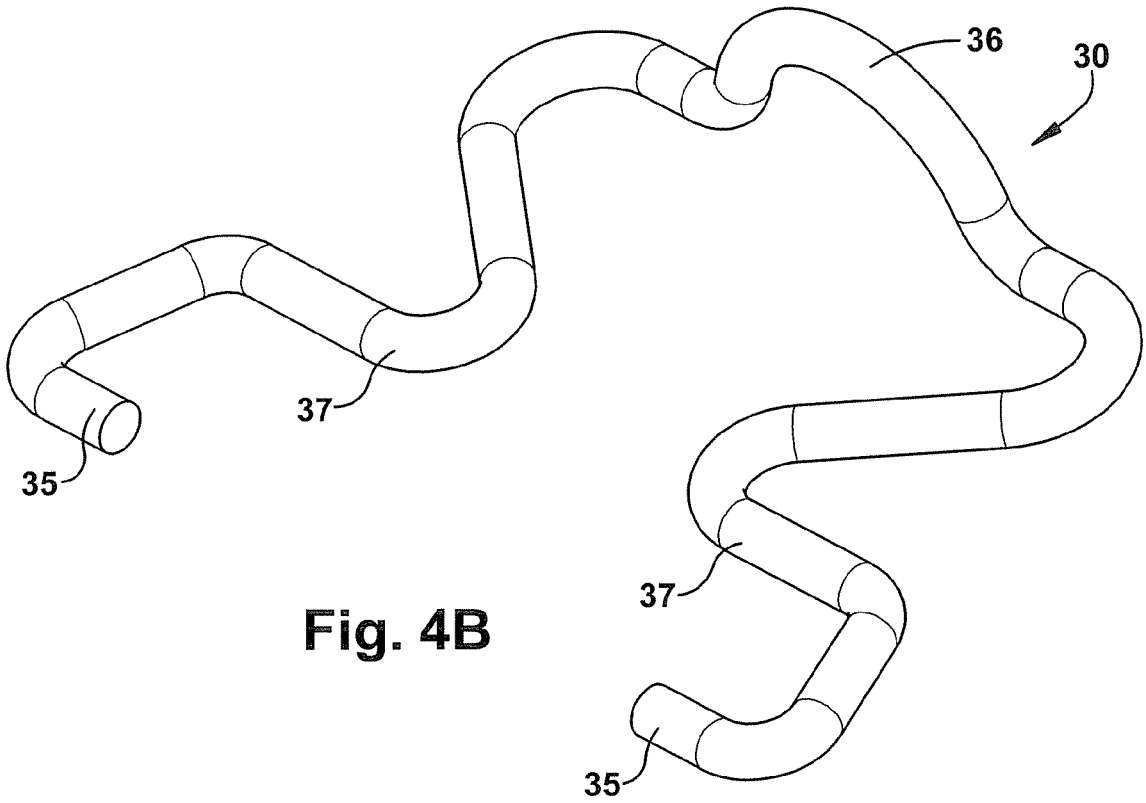
FIG. 4B illustrates a rear perspective view of the retaining member of FIG. 4A.

Many different types of retaining members may be utilized for many different ways of retaining a connector within a body. In one embodiment, a retaining member may include a prong retaining portion configured to extend through a transverse aperture in one or more prongs of an electrical plug (as conventionally provided with a 110 volt AC plug) when the retaining member is moved from a releasing position to a retaining position. As the retaining member moves from the retaining position back to the releasing position, the prong retaining portion withdraws from the transverse aperture or apertures to allow the electrical plug to be removed from the body. As shown in FIGS. 2 and 3A-3C, the exemplary device 10 includes a retaining member 30 disposed within the body 20. The exemplary retaining member 30, as more clearly shown in FIGS. 4A and 4B, is a single piece spring wire that includes at each end hooks or prong retaining portions 35 configured to extend laterally across the slots 22 and through the prong apertures A1, A2 when the retaining member 30 is moved to a prong retaining position by insertion of the prongs P1, P2 (see FIG. 3C).

Many different configurations may be used to axially move a retaining member in response to insertion of an electrical plug into the body of a lockout device. In one embodiment, prong engaging portions extend across the slots, such that the ends of the prongs abut the prong engaging portions to axially push the retaining member from the releasing position to the retaining position during plug insertion. In the illustrated embodiment, laterally inward bends of the spring wire retaining member 30 form prong engaging portions 37 or "push feet," which are axially pushed by the ends of the plug prongs P1, P2 during plug insertion (see FIG. 3B).

Many mechanisms may be utilized to direct the prong retaining portions 35 across the slots 22 and through the prong apertures A1, A2 as a result of axial movement of the retaining member 30. In one embodiment, a body includes guide surfaces or walls positioned to direct one or more prong retaining portions across slots in the body for insertion through transverse apertures in one or more prongs. In the exemplary embodiment, as illustrated in FIGS. 3A-3C, the body 20 includes axially extending retaining guide walls 25 configured to squeeze retaining portions 35 of spring wire retaining member 30 inward as the prongs P1, P2 are inserted into the body 20. As shown, the guide walls 25 may be angled inward to gradually squeeze or extend the retaining portions 35 during plug insertion, which may facilitate alignment with the prong apertures A1, A2, and ease of plug insertion.

The retaining member 30 may be resiliently biased outward, such that as the retaining member 30 is axially pulled from the prong retaining position, the prong retaining portions 35 are permitted to spring outward to retract out of the slots 22 and withdraw from the prong apertures A1, A2 (see FIG. 3A). Additionally or alternatively, the body 20 may include axially extending releasing guide walls 26, which may engage laterally inner surfaces of the retaining member 30 to push retaining portions 35 outward and withdraw them from the prong apertures A1, A2.

In another embodiment (not shown), retaining guide walls may be disposed laterally inward of an inwardly biased retaining member, such that axial movement of the retaining member forces outward facing hooks or retaining portions outward through prong apertures. As the retaining member is axially pulled from the prong retaining position, the prong retaining portions are permitted to spring inward to retract out of the slots and withdraw from the prong apertures. Additionally or alternatively, the body may include axially extending releasing guide walls laterally outward of the retaining member, which may engage laterally outer surfaces of the retaining member to push retaining portions inward and withdraw them from the prong apertures.

Figure 7:
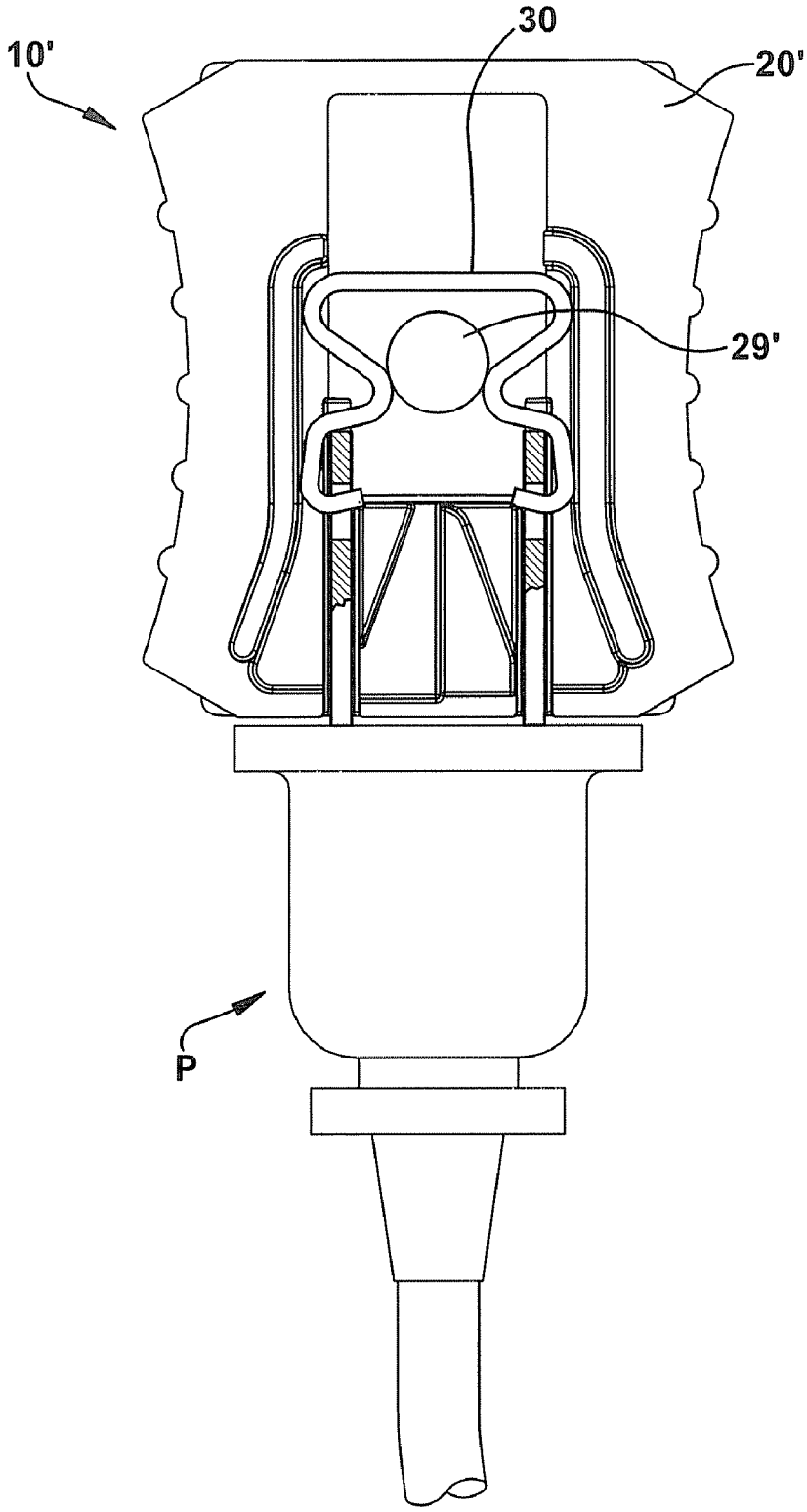
FIG. 7 illustrates a cross sectional view of a lockout device having a lock opening in the body.

Many different mechanisms may be used to lock or secure a retaining member of a lockout device in a connector retaining position, including, for example, locking key cylinders, combination lock arrangements, and other such mechanisms. In one embodiment, a lock opening may be provided with the lockout device, the lock opening being positioned or configured to accept a locking member, such as, for example, a cable or the shackle of a padlock. When a locking member is secured in the lock opening, movement of the retaining member from the retaining position to the releasing position is prevented. In one example, shown in FIG. 7, a lockout device 10' includes a lock opening 29' positioned in front and rear walls of the body 20' such that insertion of a lock member (not shown) through the opening 29' would prevent movement of the retaining member 30 back to the prong releasing position.

Figure 5A:
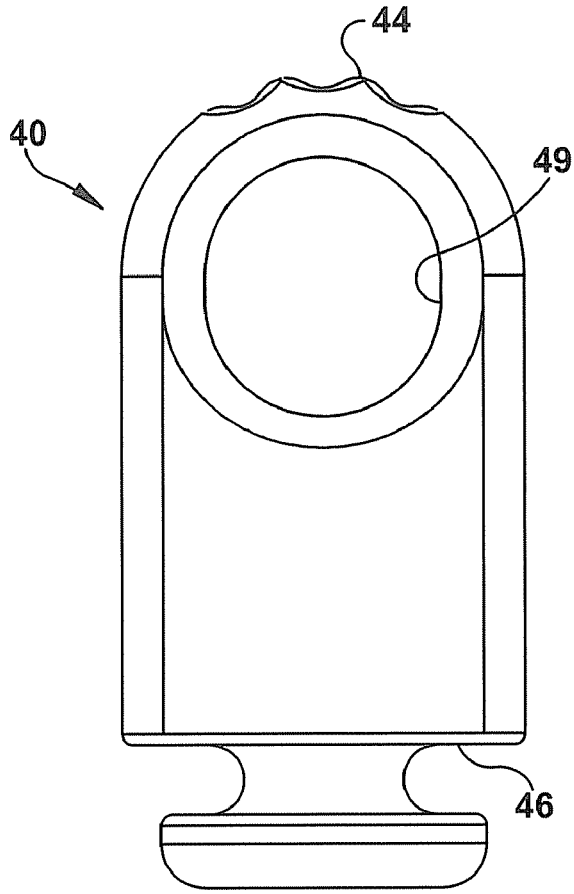
FIG. 5A illustrates a front view of the plunger of the lockout device of FIG. 1.
Figure 5B:
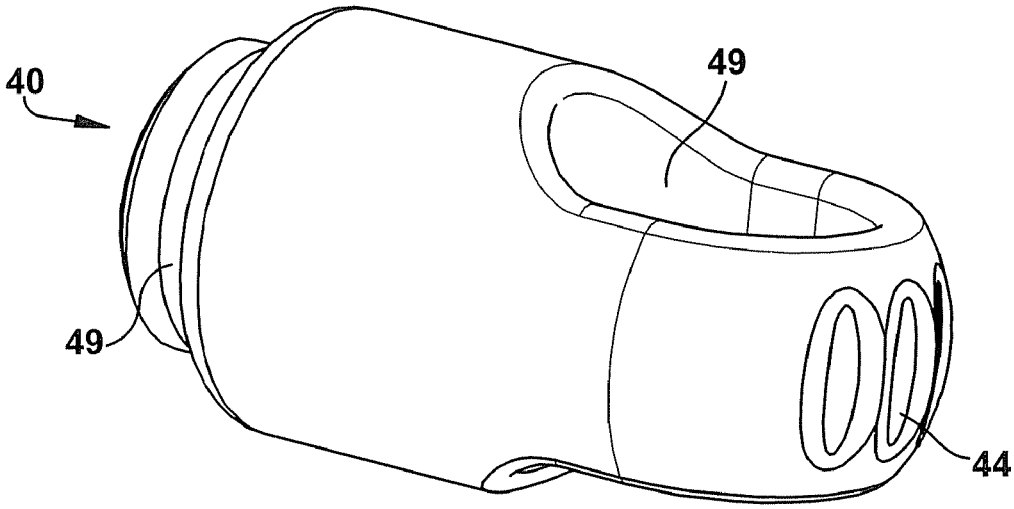
FIG. 5B illustrates a side perspective view of the plunger of FIG. 5A.

In the illustrated embodiment of FIGS. 1-6, as most clearly shown in FIGS. 2, 5A, and 5B, a plunger 40 is assembled with the retaining member 30 for mutual axial movement of the plunger 40 and retaining member 30. When the retaining member 30 is axially moved from the prong releasing position to the prong retaining position, the plunger 40 extends through an opening 29 in a second end of the body 20 to expose a lock opening 49 of the plunger 40. When a locking member is secured in the lock opening 49 of the plunger 40, axial movement of the plunger 40 and retaining member 30 is prevented, and the retaining member is held in the prong retaining position. While many different configurations may be used to connect the plunger 40 with the retaining member 30, in the illustrated embodiment, the plunger 40 includes a grooved portion 46 sized to receive a loop portion 36 of the retaining member 30.

Figure 8A:
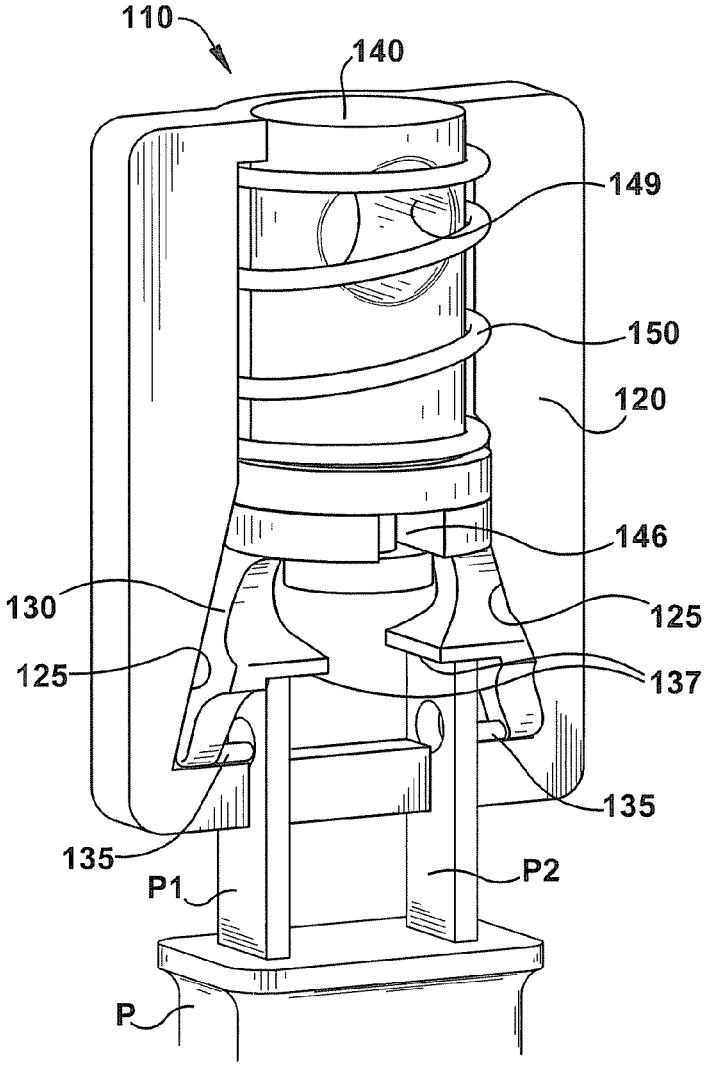
FIG. 8A illustrates a perspective view of a lockout device, with one body half removed to show additional features of the device.
Figure 8B:
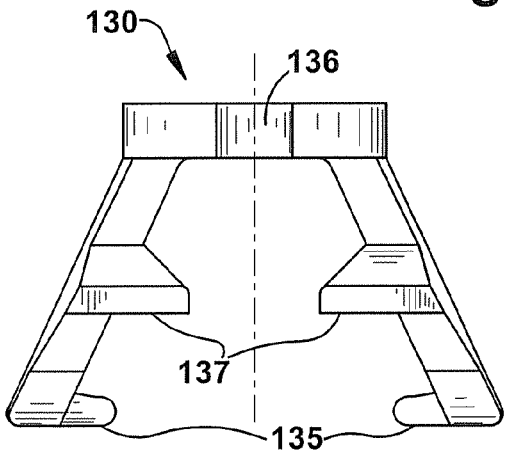
FIG. 8B illustrates a front view of the retainer clip of the lockout device of FIG. 8A.
Figure 8C:
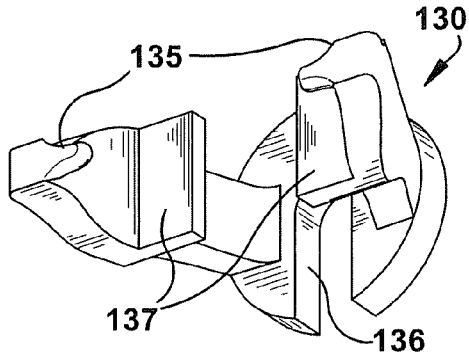
FIG. 8C illustrates a bottom perspective view of the retainer clip of FIG. 8B.

In another embodiment, as shown in FIG. 8A, a lockout device 110 includes a plastic (for example, molded nylon) retainer clip 130 including prong retaining portions 135 and prong engaging portions 137. Angled guide walls 125 force the retaining portions 135 inward into a prong retaining position when the prongs P1, P2 are inserted into the slots 122 and pressed against the prong engaging portions 137. Axial movement of the retainer clip 130 and connected plunger 140 exposes a lock opening 149, allowing it to receive a locking member (not shown) for securing the retainer clip 130 in the prong retaining position. As shown, the device 110 may, but need not, include a spring 150 disposed between an inner surface of the body 120 and an outer surface of the plunger 140 to bias the retainer clip 130 back to the prong releasing position. As more clearly shown in FIGS. 8B and 8C, the retainer clip 130 may include a slot 136 for connecting with a grooved portion 146 (FIG. 8A) of the plunger 140.

Figure 6A:
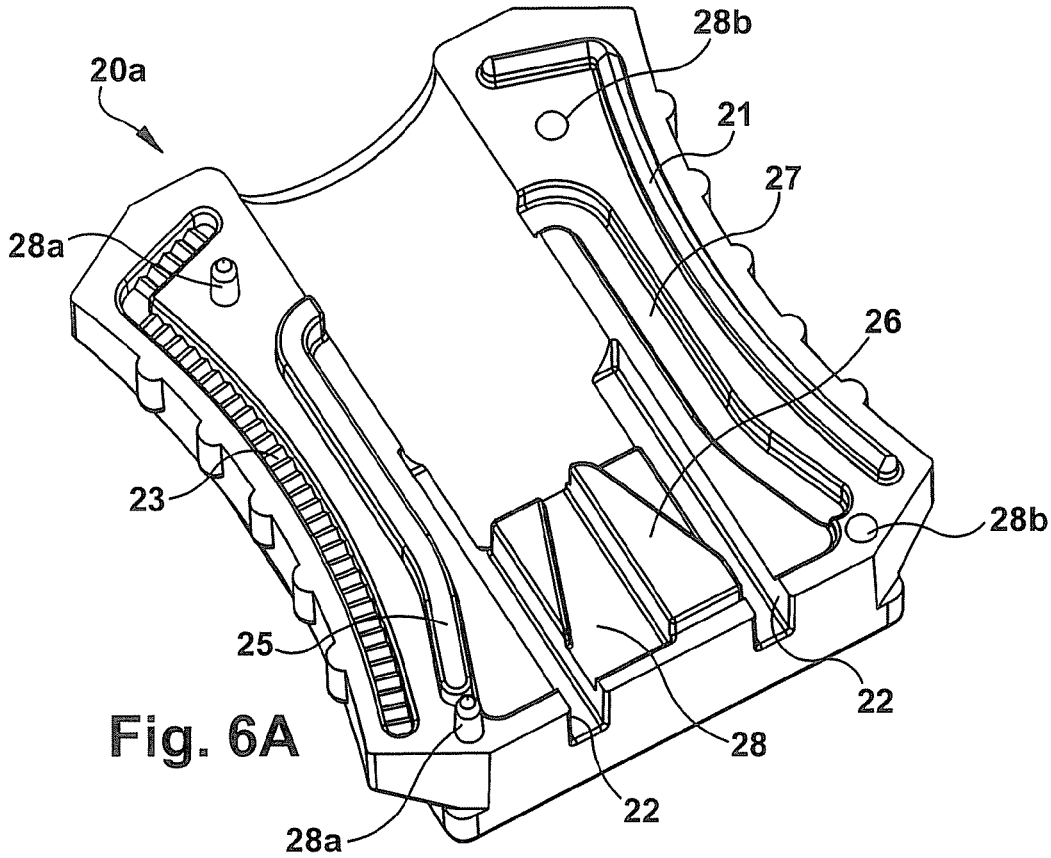
FIG. 6A illustrates a perspective view of a body half of the lockout device of FIG. 1.
Figure 6B:
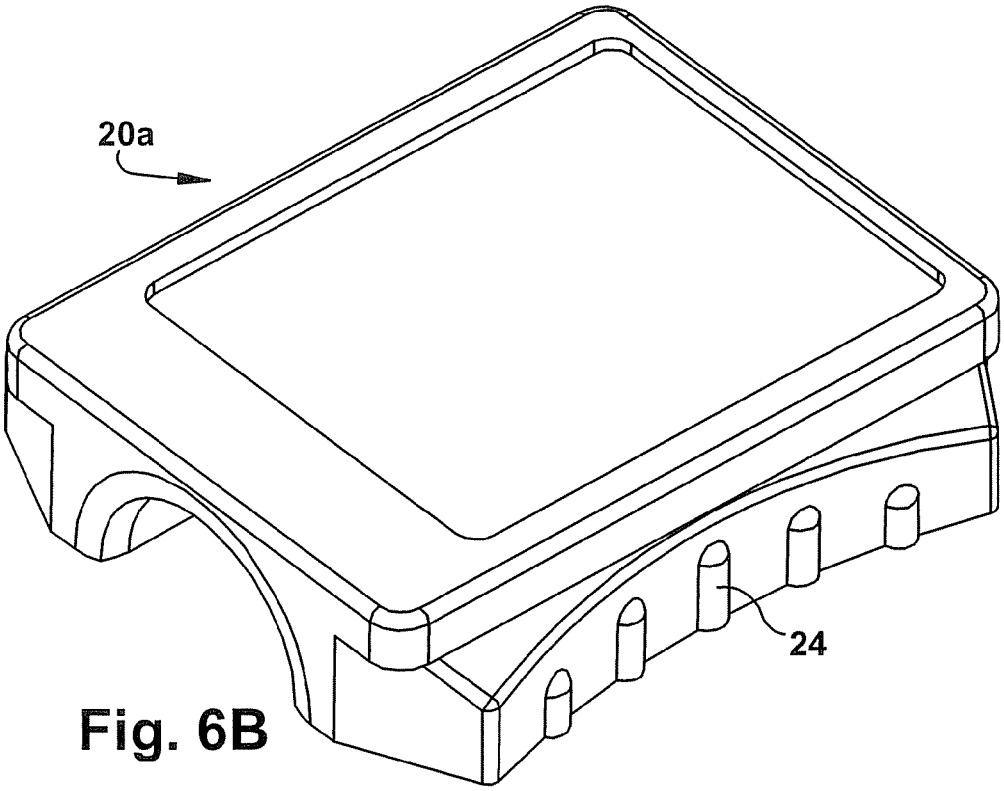
FIG. 6B illustrates a perspective view of another body half of the lockout device of FIG. 1.

While many different materials may be used to form the body and plunger, in one embodiment, the body and plunger may be made from a non-conductive, insulating material, such as a polymer, to provide a dielectric lockout device which insulates the electrical cord plug from being accidentally energized. The body may be produced from two body halves joined, for example, by adhesives, fasteners, or welding. In one embodiment, the body may be produced from two body halves that are substantially identical, which may facilitate improved efficiencies in manufacturing, inventory storage, and assembly. In the illustrated embodiment, as shown in FIGS. 6A and 6B, the body 20 is formed from two identical body halves 20*a*. Each body half 20*a* includes an outer retaining guide wall 25 and a slot 27 for aligning with and receiving the retaining guide wall 25 of the other body half. Further, each body half 20*a* includes an inner wedge shaped releasing guide wall 26 and a recess 28 for aligning with and receiving the releasing guide wall 26 of the other body half. The body halves 20*a* may further be provided with complementary bead 21 and groove 23 weld features, to facilitate with ultrasonic welding of the polymer body halves 20*a*. Additionally or alternatively, the body halves 20*a* may be provided with complementary shaped pins 28*a* and bores 28*b*, for example, to facilitate alignment of the body halves 20*a* or to provide a snap-fit assembly of the body 20.

Other features may be provided with the lockout device 10. For example, as shown in FIG. 1, gripping surfaces 24 may be provided in the sides of the body 20 to intuitively guide the user to hold the device in the most practical position when using the device, also providing a gripping surface to hold onto when removing the plug from the device. Similar gripping surfaces 44 may be provided on the plunger 40 (see FIGS. 5A and 5B). Flat, recessed surfaces may be provided on the front and back sides of the body 20 to facilitate adhesion of rewritable or permanent labels (see FIG. 1).

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A lockout device for an electrical plug having at least first and second prongs including corresponding first and second transverse apertures, the device comprising:

a body including at least a first slot disposed on a first end of the body, the first slot being sized to receive the first prong of the electrical plug; and a retaining member disposed within the body and movable between a prong retaining position and a prong releasing position, the retaining member comprising:

a prong engaging portion configured to engage at least one of the first and second prongs when the first prong is inserted in the first slot for movement of the retaining member from the prong releasing position to the prong retaining position; and a prong retaining portion configured to be in an extended position when the retaining member is in the prong retaining position, such that the prong retaining portion extends through the first transverse aperture when the first prong is inserted in the first slot, the prong retaining portion being further configured to be axially moved within the body to a retracted position when the retaining member is moved to the prong releasing position, such that the prong retaining portion withdraws from the first transverse aperture when the first prong is pulled from the first slot.

2. The lockout device of claim 1, further comprising a lock opening sized to receive a lock member therethrough for preventing movement of the retaining member from the prong retaining position to the prong releasing position.

3. The lockout device of claim 2, wherein the lock opening is disposed in a plunger assembled with the retaining member for axial movement therewith.

4. The lockout device of claim 3, wherein the plunger extends from an opening in a second end of the body when the retaining member is in the prong retaining position.

5. The lockout device of claim 1, further comprising means for selectively preventing movement of the retaining member from the prong retaining position to the prong releasing position.

6. The lockout device of claim 1, wherein the body further comprises at least one axially extending retaining guide wall configured to hold the prong retaining portion in the extended position when the retaining member is in the prong retaining position.

7. The lockout device of claim 6, wherein the at least one retaining guide wall includes an angled camming portion for directing the prong retaining portion from the retracted position to the extended position as the retaining member is moved from the releasing position to the retaining position.

8. The lockout device of claim 1, wherein the body further comprises at least one axially extending releasing guide wall configured to hold the prong retaining portion in the retracted position when the retaining member is in the prong releasing position.

9. The lockout device of claim 8, wherein the at least one releasing guide wall includes an angled camming portion for returning the prong retaining portion from the extended position to the retracted position as the retaining member is moved from the retaining position to the releasing position.

10. The lockout device of claim 1, wherein the body comprises first and second body halves that are substantially identical.

11. The lockout device of claim 1, wherein the retaining member comprises a single piece spring wire.

12. The lockout device of claim 11, wherein a first end of the single piece spring wire forms the prong retaining portion.

13. The lockout device of claim 11, wherein a laterally inward bend of the single piece spring wire forms the prong engaging portion.

14. The lockout device of claim 1, wherein the prong retaining portion of the retaining member is resiliently biased toward the retracted position.

15. A lockout device for an electrical plug having at least first and second prongs including corresponding first and second transverse apertures, the device comprising:

a body including first and second slots disposed on a first end of the body, the first and second slots being sized to receive the first and second prongs of the electrical plug; and a retaining member disposed within the body, the entire retaining member being axially movable with respect to the first and second slots between a prong retaining position and a prong releasing position, the retaining member comprising:

first and second prong engaging portions configured to engage the first and second prongs when the first and second prongs are inserted in the first and second slots for movement of the retaining member from the prong releasing position to the prong retaining position; and first and second prong retaining portions configured to be in extended positions when the retaining member is in the prong retaining position, such that the first and second prong retaining portion extend through the first and second transverse apertures when the first and second prongs are inserted in the first and second slots, the first and second prong retaining portions being further configured to be in retracted positions when the retaining member is in the prong releasing position, such that the first and second prong retaining portions withdraw from the first and second transverse apertures when the first and second prongs are pulled from the first and second slots.

16. The lockout device of claim 15, wherein the extended positions of the first and second prong retaining portions are laterally inward of the retracted positions of the prong retaining portion.

17. The lockout device of claim 15, wherein the retaining member comprises a single piece spring wire.

18. The lockout device of claim 17, wherein first and second ends of the single piece spring wire form the first and second prong retaining portions.

19. The lockout device of claim 17, wherein first and second laterally inward bends of the single piece spring wire form the first and second prong engaging portions.

20. A method for lockably preventing access to an electrical plug having at least first and second prongs including corresponding first and second transverse apertures, the method comprising:

providing a lockout device comprising a body including first and second slots disposed on a first end of the body, the first and second slots being sized to receive the first and second prongs of the electrical plug; and a retaining member disposed within the body and axially movable with respect to the first and second slots between a prong retaining position and a prong releasing position;

inserting the first and second prongs into the first and second slots, such that the first and second prongs axially move the retaining member from the prong releasing position to the prong retaining position; and lockably securing the retaining member in the prong retaining position.

21. The method of claim 20, wherein lockably securing the retaining member in the prong retaining position comprises securing a locking member through a lock opening in the lockout device, such that the locking member prevents movement of the retaining member from the prong retaining position to the prong releasing position.

* * * * *